US008235519B2

(12) United States Patent
Kusunoki

(10) Patent No.: US 8,235,519 B2
(45) Date of Patent: Aug. 7, 2012

(54) IMAGE FORMING APPARATUS AND METHOD

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 479 days.

(21) Appl. No.: 12/396,981

(22) Filed: Mar. 3, 2009

(65) Prior Publication Data

US 2009/0225144 A1 Sep. 10, 2009

(30) Foreign Application Priority Data

Mar. 4, 2008 (JP) ..... 2008-053535

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 6,221,138 | B1 * | 4/2001 | Kenny | 106/31.32 |
| 6,682,189 | B2 * | 1/2004 | May et al. | 347/103 |
| 6,767,092 | B2 * | 7/2004 | May et al. | 347/103 |
| 6,883,908 | B2 * | 4/2005 | Young et al. | 347/102 |
| 7,597,438 | B2 * | 10/2009 | Konno et al. | 347/102 |
| 7,628,481 | B2 * | 12/2009 | Kadomatsu et al. | 347/102 |
| 7,651,212 | B2 * | 1/2010 | Kadomatsu et al. | 347/102 |
| 7,717,551 | B2 * | 5/2010 | Kadomatsu et al. | 347/102 |
| 7,815,303 | B2 * | 10/2010 | Kasai | 347/102 |
| 2005/0168558 | A1 * | 8/2005 | Moore et al. | 347/112 |
| 2006/0214970 | A1 | 9/2006 | Hirakawa | |
| 2006/0214984 | A1 * | 9/2006 | Hirakawa | 347/31 |
| 2007/0046720 | A1 | 3/2007 | Konno et al. | |
| 2007/0296790 | A1 * | 12/2007 | Nakazawa et al. | 347/102 |
| 2008/0152825 | A1 | 6/2008 | Mukai et al. | |

(Continued)

FOREIGN PATENT DOCUMENTS

JP 02-212149 * 8/1990

(Continued)

OTHER PUBLICATIONS

JP Office Action issued in corresponding JP application No. 2008-053535 on Dec. 9, 2011.

(Continued)

*Primary Examiner* — Charlie Peng
(74) *Attorney, Agent, or Firm* — Birch, Stewart, Kolasch & Birch, LLP

(57) ABSTRACT

The image forming apparatus forms an image on a recording medium by using an ink and an aggregating treatment agent. The ink contains coloring material, and the aggregating treatment agent contains a component which causes the coloring material to aggregate. The image forming apparatus includes: a treatment liquid deposition device which deposits a treatment liquid onto the recording medium, the treatment liquid containing the aggregating treatment agent; a treatment liquid heating device which heats the treatment liquid having been deposited on the recording medium to form a solid or semi-solid layer of the aggregating treatment agent on the recording medium; a treatment liquid permeation suppression device which suppresses permeation of the treatment liquid into the recording medium at least from a time of deposition of the treatment liquid onto the recording medium until formation of the solid or semi-solid layer of the aggregating treatment agent; and an ink droplet ejection device which ejects and deposits droplets of the ink onto the recording medium on which the solid or semi-solid layer of the aggregating treatment agent has been formed.

4 Claims, 7 Drawing Sheets

U.S. PATENT DOCUMENTS

| | | | | |
|---|---|---|---|---|
| 2009/0130320 | A1* | 5/2009 | Kawakami et al. | 427/387 |
| 2011/0200797 | A1 | 8/2011 | Mukai et al. | |
| 2011/0200798 | A1 | 8/2011 | Mukai et al. | |
| 2011/0200799 | A1 | 8/2011 | Mukai et al. | |

FOREIGN PATENT DOCUMENTS

| | | | |
|---|---|---|---|
| JP | 3-92351 | A | 4/1991 |
| JP | 2001-47640 | A | 2/2001 |
| JP | 2004-10633 | A | 1/2004 |
| JP | 2004-345189 | A | 12/2004 |
| JP | 2005-306025 | A | 11/2005 |
| JP | 2006-88392 | A | 4/2006 |
| JP | 2006-264267 | A | 10/2006 |
| JP | 2006-281633 | A | 10/2006 |
| JP | 2006-281638 | A | 10/2006 |
| JP | 2006-327034 | A | 12/2006 |
| JP | 2007-55083 | A | 3/2007 |
| JP | 2007-55084 | A | 3/2007 |
| JP | 2007-168252 | A | 7/2007 |
| JP | 2008-961 | A | 1/2008 |

OTHER PUBLICATIONS

JP Office Action issued Mar. 7, 2012 in corresponding JP Application No. 2008-053635.

* cited by examiner

IMAGE FORMING APPARATUS AND METHOD

BACKGROUND OF THE INVENTION

1. Field of the Invention

The present invention relates to an image forming apparatus and an image forming method, and more particularly to an image forming apparatus and an image forming method in which an image is formed on an image formation body by using an ink and a treatment agent.

2. Description of the Related Art

In the inkjet recording system, the recording is performed by ejecting ink droplets onto a recording medium. By contrast with other systems, noise during the recording operation is low, running cost is low, and image recording with high resolution and high quality can be performed. The ink ejection system can be a piezoelectric system using the displacement of a piezoelectric element or a thermal system using thermal energy generated by a heat-generating element.

However, the problem associated with the inkjet recording system is that where the adjacent ink droplets (dots) overlap to each other when the ink droplets are continuously deposited onto the recording medium, the so-called landing interference (bleeding) occurs, namely, the ink droplets forming the adjacent dots merge under the effect of surface tension on the recording medium and dots of desired shape and size cannot be formed. Where the aforementioned landing interference occurs, when the dots have the same color, the shape of dots collapses, and when the dots of different colors are obtained, not only the dot shape collapses, but also colors are mixed.

A two-liquid aggregation system using a treatment liquid that reacts with ink and causes the ink to aggregate has been suggested as means for preventing such landing interference occurring between the ink droplets on the recording medium. For example, Japanese Patent Application Publication No. 2004-010633 discloses a technology that improves optical density, oozing, oozing between colors (bleeding), and drying time in the two-liquid aggregation system by imparting acidic properties to one liquid from among the liquid composition (treatment liquid) and ink and imparting alkaline properties to the other and controlling the aggregation ability of the pigment on the recording medium.

However, if a layer of the treatment liquid is present on the recording medium, then the ink droplets deposited onto the treatment liquid layer float inside the treatment liquid layer and hence the ink coloring material moves. As a result of this, a problem arises in that the output image is disturbed significantly with respect to the desired image. Furthermore, if the treatment liquid permeates into the image receiving layer of the recording medium after the deposition of the treatment liquid on the recording medium and before the deposition of ink droplets, then a sufficient aggregating reaction does not occur on the surface of the recording medium, and hence there is also a problem in that a bleeding prevention effect is not obtained.

In particular, in a system where the deposition of the treatment liquid and the deposition of the ink droplets are performed by independent line heads, a time period of the order of several seconds is required from the deposition of the treatment liquid onto the recording medium until the deposition of the ink droplets, and hence a portion of the treatment liquid permeates into the recording medium and it is not possible to form an aggregating treatment liquid layer of sufficient volume on the surface of the recording medium. Moreover, if ink droplets are continuously ejected at high speed in such a manner that a plurality of ink droplets are mutually overlapping on the recording medium (for example, at a droplet ejection interval of 10 to 50 microseconds), then the aggregating reaction of the ink droplets that have been previously deposited cannot proceed sufficiently rapidly, and bleeding occurs.

SUMMARY OF THE INVENTION

The present invention has been contrived in view of the circumstances described above, an object thereof being to provide an image forming apparatus and an image forming method whereby, in a two-liquid aggregating system which uses ink and treatment liquid, an aggregating reaction of the ink on the recording medium can be carried out efficiently, and image deterioration caused by movement of the coloring material or bleeding can be prevented.

In order to attain the aforementioned object, the present invention is directed to an image forming apparatus which forms an image on a recording medium by using an ink and an aggregating treatment agent, the ink containing coloring material, the aggregating treatment agent containing a component which causes the coloring material to aggregate, the apparatus comprising: a treatment liquid deposition device which deposits a treatment liquid onto the recording medium, the treatment liquid containing the aggregating treatment agent; a treatment liquid heating device which heats the treatment liquid having been deposited on the recording medium to form a solid or semi-solid layer of the aggregating treatment agent on the recording medium; a treatment liquid permeation suppression device which suppresses permeation of the treatment liquid into the recording medium at least from a time of deposition of the treatment liquid onto the recording medium until formation of the solid or semi-solid layer of the aggregating treatment agent; and an ink droplet ejection device which ejects and deposits droplets of the ink onto the recording medium on which the solid or semi-solid layer of the aggregating treatment agent has been formed.

According to this aspect of the present invention, by suppressing the permeation of the treatment liquid deposited onto the recording medium while heating and drying the treatment liquid, it is possible reliably to form the solid or semi-solid aggregating treatment agent layer on the surface of the recording medium. By depositing droplets of the ink onto the recording medium on which the solid or semi-solid aggregating treatment agent layer has been formed, it is possible to achieve an efficient ink aggregating reaction on the surface of the recording medium, even in the case of high-speed droplet ejection with a droplet ejection interval of 10 to 50 microseconds, and hence it is possible to prevent image deterioration caused by movement of the coloring material or bleeding, and therefore an image of high quality can be formed.

In the present specification, the term of "solid or semi-solid aggregating treatment agent (aggregating treatment agent layer)" includes an aggregating treatment agent (aggregating treatment agent layer) having a solvent content rate of 0% to 70%, where the solvent content rate is defined as a ratio ($(X_2/X_1)\times100$) of a weight $X_2$ (g/m$^2$) per unit surface area of solvent contained in the aggregating treatment agent to a weight $X_1$ (g/m$^2$) per unit surface area of the aggregating treatment agent.

In the present specification, the term of "aggregating treatment agent" broadly includes the aggregating treatment agent of the solid or semi-solid state and the aggregating treatment agent in a liquid state. In particular, the aggregating treatment agent in the liquid state of which the solvent content rate is not less than 70% is referred to as an "aggregating treatment liquid".

It is preferable that the treatment liquid includes an electrorheological fluid; and the treatment liquid permeation suppression device includes an electric field application device which applies an electric field to the treatment liquid.

It is also preferable that the treatment liquid includes a magnetic fluid; and the treatment liquid permeation suppression device includes a magnetic field application device which applies a magnetic field to the treatment liquid.

It is also preferable that the treatment liquid permeation suppression device includes a permeation suppression agent deposition device which deposits a permeation suppression agent onto the recording medium before the treatment liquid is deposited onto the recording medium, the permeation suppression agent having a repelling property with respect to the treatment liquid.

In order to attain the aforementioned object, the present invention is also directed to an image forming method of forming an image on a recording medium by using an ink and an aggregating treatment agent, the ink containing coloring material, the aggregating treatment agent containing a component which causes the coloring material to aggregate, the method comprising the steps of: depositing a treatment liquid onto the recording medium, the treatment liquid containing the aggregating treatment agent; heating the treatment liquid having been deposited on the recording medium in the depositing step to form a solid or semi-solid layer of the aggregating treatment agent on the recording medium; suppressing permeation of the treatment liquid into the recording medium at least from a time of deposition of the treatment liquid onto the recording medium in the depositing step until formation of the solid or semi-solid layer of the aggregating treatment agent in the heating step; and ejecting and depositing droplets of the ink onto the recording medium on which the solid or semi-solid layer of the aggregating treatment agent has been formed.

According to this aspect of the present invention, by suppressing the permeation of the treatment liquid deposited onto the recording medium while heating and drying the treatment liquid, it is possible reliably to form the solid or semi-solid aggregating treatment agent layer on the surface of the recording medium. By depositing droplets of the ink onto the recording medium on which the solid or semi-solid aggregating treatment agent layer has been formed, it is possible to achieve an efficient ink aggregating reaction on the surface of the recording medium, even in the case of high-speed droplet ejection with a droplet ejection interval of 10 to 50 microseconds, and hence it is possible to prevent image deterioration caused by movement of the coloring material or bleeding, and therefore an image of high quality can be formed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
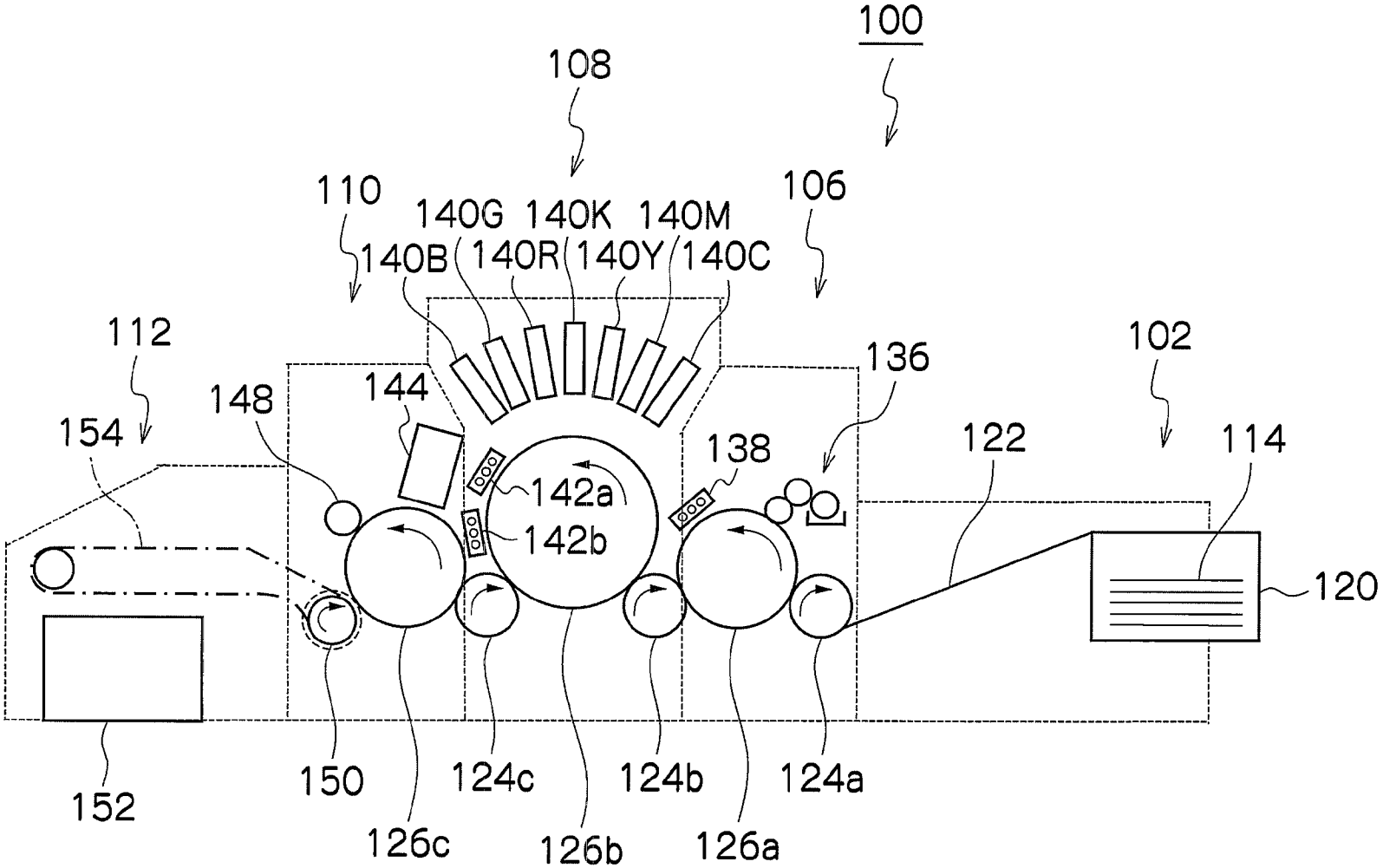
FIG. 1 is a general schematic drawing showing an inkjet recording apparatus according to an embodiment of the present invention.

Firstly, the ink and the aggregating treatment liquid (hereinafter also referred to simply as "treatment liquid") used in an embodiment of the present invention will be described, and then the image forming apparatus according to an embodiment of the present invention will be described.

Ink

The ink used in the present embodiment is water-based pigment ink that contains the following materials insoluble to the solvent (water): pigment particles as the coloring material, and polymer particles.

It is desirable that the concentration of the solvent-insoluble materials in the ink is not less than 1 wt % and not more than 20 wt %, taking account of the fact that the viscosity of the ink suitable for ejection is 20 mPa·s or lower. It is more desirable that the concentration of the pigment in the ink is not less than 4 wt %, in order to obtain good optical density in the image. It is desirable that the surface tension of the ink is not less than 20 mN/m and not more than 40 mN/m, taking account of ejection stability.

The coloring material in the ink may be pigment or a combination of pigment and dye. From the viewpoint of the aggregating characteristics when the ink comes into contact with the treatment liquid, a dispersed pigment in the ink is desirable for more effective aggregation. Desirable pigments include: a pigment dispersed by a dispersant, a self-dispersing pigment, a pigment in which the pigment particle is coated with a resin (hereinafter referred to as "microcapsule pigment"), and a polymer grafted pigment. Moreover, from the viewpoint of the aggregating characteristics of the coloring material, it is more desirable that the coloring material is modified with a carboxyl group having a low degree of dissociation.

There are no particular restrictions on the resin used for a microcapsule pigment, but desirably, it should be a compound of high molecular weight which has a self-dispersing capability or solubility in water, and contains an anionic group (acidic). Generally, it is desirable that the resin should have a number average molecular weight in the approximate range of 1,000 to 100,000, and especially desirably, in the approximate range of 3,000 to 50,000. Moreover, desirably, this resin can dissolved in an organic solvent to form a solution. By limiting the number average molecular weight of the resin to this range, it is possible to make the resin display satisfactory functions as a covering film for the pigment particle, or as a coating film in the ink composition.

The resin may itself have a self-dispersing capability or solubility, or these functions may be added or introduced. For example, it is possible to use a resin having an introduced carboxyl group, sulfonic acid group, or phosphonic acid group or another anionic group, by neutralizing with an organic amine or alkali metal. Moreover, it is also possible to use a resin into which one or two or more anionic groups of the same type or different types have been introduced. In the embodiment of the present invention, it is desirable to use a resin which has been neutralized by means of a salt and which contains an introduced carboxyl group.

There are no particular restrictions on the pigment used in the present embodiment, and specific examples of orange and yellow pigments are: C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 128, C. I. Pigment Yellow 138, C. I. Pigment Yellow 151, C. I. Pigment Yellow 155, C. I. Pigment Yellow 180, and C.I. Pigment Yellow 185.

Specific examples of red and magenta pigments are: C. I. Pigment Red 2, C. I. Pigment Red 3, C. I. Pigment Red 5, C. I Pigment Red 6, C. I. Pigment Red 7, C. I. Pigment Red 15, C. I. Pigment Red 16, C. I. Pigment Red 48: 1, C. I. Pigment Red 53: 1, C. I. Pigment Red 57: 1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, and C.I. Pigment Red 222.

Specific examples of green and cyan pigments are: C. I. Pigment Blue 15, C. I. Pigment Blue 15:2, C. I. Pigment Blue 15:3, C. I. Pigment Blue 16, C. I. Pigment Blue 60, and C.I. Pigment Green 7.

Specific examples of a black pigment are: C.I. Pigment Black 1, C.I. Pigment Black 6, and C.I. Pigment Black 7.

It is desirable in the present embodiment that the ink contains polymer particles that do not contain any colorant, as a component for reacting with the treatment liquid. The polymer particles can improve the image quality by strengthening the ink viscosity raising action and the aggregating action through reaction with the treatment liquid. In particular, a highly stable ink can be obtained by adding anionic polymer particles to the ink.

By using the ink containing the polymer particles that produce the viscosity raising action and the aggregating action through reaction with the treatment liquid, it is possible to increase the quality of the image, and at the same time, depending on the type of polymer particles, the polymer particles may form a film on the recording medium, and therefore beneficial effects can be obtained in improving the wear resistance and the waterproofing characteristics of the image.

The method of dispersing the polymer particles in the ink is not limited to adding an emulsion of the polymer particles to the ink, and the resin may also be dissolved, or included in the form of a colloidal dispersion, in the ink.

The polymer particles may be dispersed by using an emulsifier, or the polymer particles may be dispersed without using any emulsifier. For the emulsifier, a surface active agent of low molecular weight is generally used, and it is also possible to use a surface active agent of high molecular weight. It is also desirable to use a capsule type of polymer particles having an outer shell composed of acrylic acid, methacrylic acid, or the like (core-shell type of polymer particles in which the composition is different between the core portion and the outer shell portion).

The polymer particles dispersed without any surface active agent of low molecular weight are known as the soap-free latex, which includes polymer particles with no emulsifier or a surface active agent of high molecular weight. For example, the soap-free latex includes polymer particles that use, as an emulsifier, the above-described polymer having a water-soluble group, such as a sulfonic acid group or carboxylic acid group (a polymer with a grafted water-soluble group, or a block polymer obtained from a monomer having a water-soluble group and a monomer having an insoluble part).

It is especially desirable in the present embodiment to use the soap-free latex compared to other type of resin particles obtained by polymerization using an emulsifier, since there is no possibility that the emulsifier inhibits the aggregating reaction and film formation of the polymer particles, or that the free emulsifier moves to the surface after film formation of the polymer particles and thereby degrades the adhesive properties between the recording medium and the ink aggregate in which the coloring material and the polymer particles are combined.

Examples of the resin component added as the resin particles to the ink include: an acrylic resin, a vinyl acetate resin, a styrene-butadiene resin, a vinyl chloride resin, an acrylstyrene resin, a butadiene resin, and a styrene resin.

In order to make the polymer particles have high speed aggregation characteristics, it is desirable that the polymer particles contain a carboxylic acid group having a low degree of disassociation. Since the carboxylic acid group is readily affected by change of pH, then the polymer particles containing the carboxylic acid group easily change the state of the dispersion and have high aggregation characteristics.

The change in the dispersion state of the polymer particles caused by change in the pH can be adjusted by means of the component ratio of the polymer particle having a carboxylic acid group, such as ester acrylate, or the like, and it can also be adjusted by means of an anionic surfactant which is used as a dispersant.

Desirably, the resin constituting the polymer particles is a polymer that has both of a hydrophilic part and a hydrophobic part. By incorporating a hydrophobic part, the hydrophobic part is oriented toward to the inner side of the polymer particle, and the hydrophilic part is oriented efficiently toward the outer side, thereby having the effect of further increasing the change in the dispersion state caused by change in the pH of the liquid. Therefore, aggregation can be performed more efficiently.

Examples of commercially available resin emulsion include: Joncryl 537 and 7640 (styrene-acrylic resin emulsion, manufactured by Johnson Polymer), Microgel E-1002 and E-5002 (styrene-acrylic resin emulsion, manufactured by Nippon Paint), Voncoat 4001 (acrylic resin emulsion, manufactured by Dainippon Ink and Chemicals), Voncoat 5454 (styrene-acrylic resin emulsion, manufactured by Dainippon Ink and Chemicals), SAE-1014 (styrene-acrylic resin emulsion, manufactured by Zeon Japan), Jurymer ET-410 (acrylic resin emulsion, manufactured by Nihon Junyaku), Aron HD-5 and A-104 (acrylic resin emulsion, manufactured by Toa Gosei), Saibinol SK-200 (acrylic resin emulsion, manufactured by Saiden Chemical Industry), and Zaikthene L (acrylic resin emulsion, manufactured by Sumitomo Seika Chemicals). However, the resin emulsion is not limited to these examples.

The weight ratio of the polymer particles to the pigment is desirably 2:1 through 1:10, and more desirably 1:1 through 1:3. If the weight ratio of the polymer particles to the pigment is less than 2:1, then there is no substantial improvement in the aggregating force of the aggregate formed by the cohesion of the polymer particles. On the other hand, if the weight ratio of the polymer particles to the pigment is greater than 1:10, the viscosity of the ink becomes too high and the ejection characteristics, and the like, deteriorate.

From the viewpoint of the adhesive force after the cohesion, it is desirable that the molecular weight of the polymer particles added to the ink is no less than 5,000. If it is less than 5,000, then beneficial effects are insufficient in terms of improving the internal aggregating force of the ink aggregate, achieving good fixing characteristics after transfer to the recording medium, and improving the image quality.

Desirably, the volume-average particle size of the polymer particles is in the range of 10 nm to 1 μm, more desirably, the range of 10 nm to 500 nm, even desirably 20 nm to 200 nm and particularly desirably, the range of 50 nm to 200 nm. If the particle size is equal to or less than 10 nm, then significant effects in improving the image quality or enhancing transfer characteristics cannot be expected, even if aggregation occurs. If the particle size is equal to or greater than 1 μm, then there is a possibility that the ejection characteristics from the ink head or the storage stability will deteriorate. Furthermore, there are no particular restrictions on the volume-average particle size distribution of the polymer particles and they may have a broad volume-average particle size distribution or they may have a monodisperse volume-average particle size distribution.

Moreover, two or more types of polymer particles may be used in combination in the ink.

Examples of the pH adjuster added to the ink in the present embodiment include an organic base and an inorganic alkali base, as a neutralizing agent. In order to improve storage stability of the ink for inkjet recording, the pH adjuster is desirably added in such a manner that the ink for inkjet recording has the pH of 6 through 10.

It is desirable in the present embodiment that the ink contains a water-soluble organic solvent, from the viewpoint of preventing nozzle blockages in the ejection head due to drying. Examples of the water-soluble organic solvent include a wetting agent and a penetrating agent.

Examples of the water-soluble organic solvent in the ink are: polyhydric alcohols, polyhydric alcohol derivatives, nitrous solvents, monohydric alcohols, and sulfurous solvents. Specific examples of the polyhydric alcohols are: ethylene glycol, diethylene glycol, propylene glycol, butylene glycol, triethylene glycol, 1,5-pentane diol, 1,2,6-hexane triol, and glycerin. Specific examples of the derivatives of polyhydric alcohol are: ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and an ethylene oxide adduct of diglycerin. Specific examples of the nitrous solvents are: pyrrolidone, N-methyl-2-pyrrolidone, cyclohexyl pyrrolidone, and triethanol amine. Specific examples of the monohydric alcohols are: ethanol, isopropyl alcohol, butyl alcohol, benzyl alcohol, and the like. Specific examples of the sulfurous solvents are: thio diethanol, thio diglycerol, sulfolane, and dimethyl sulfoxide. Apart from these, it is also possible to use propylene carbonate, ethylene carbonate, or the like.

The ink according to the present embodiment may contain a surface active agent.

Examples of the surface active agent in the ink include: in a hydrocarbon system, an anionic surface active agent, such as a salt of a fatty acid, an alkyl sulfate ester salt, an alkyl benzene sulfonate salt, an alkyl naphthalene sulfonate salt, a dialkyl sulfosuccinate salt, an alkyl phosphate ester salt, a naphthalene sulfonate/formalin condensate, and a polyoxyethylene alkyl sulfonate ester salt; and a non-ionic surface active agent, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerin fatty acid ester, and an oxyethylene oxypropylene block copolymer. Desirable examples of the surface active agent further include: Surfynols (manufactured by Air Products & Chemicals), which is an acetylene-based polyoxyethylene oxide surface active agent, and an amine oxide type of amphoteric surface active agent, such as N,N-dimethyl-N-alkyl amine oxide.

Moreover, it is also possible to use the surface active agents cited in Japanese Patent Application Publication No. 59-157636, pages 37 to 38, and Research Disclosure No. 308119 (1989). Furthermore, it is also possible to use a fluoride type (alkyl fluoride type), or silicone type of surface active agent such as those described in Japanese Patent Application Publication Nos. 2003-322926, 2004-325707 and 2004-309806. It is also possible to use a surface tension adjuster of this kind as an anti-foaming agent; and a fluoride or silicone compound, or a chelating agent, such as ethylenediamine tetraacetic acid (EDTA), can also be used.

The surface active agent contained in the ink has beneficial effects in raising the wetting properties on the solid or semi-solid aggregating treatment agent layer by reducing the surface tension, and therefore the aggregating action effectively progresses due to the increase in the contact surface area between the solid or semi-solid aggregating treatment agent layer and the ink.

It is desirable in the present embodiment that the ink has the surface tension of 10 mN/m through 50 mN/m; and from the viewpoint of achieving good permeability into the permeable recording medium, formation of fine droplets and good ejection properties, the surface tension of the ink is more desirably 15 mN/m through 45 mN/m.

It is desirable in the present embodiment that the ink has the viscosity of 1.0 mPa·s through 20.0 mPa·s.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

Aggregating Treatment Liquid

It is desirable in the present embodiment that the aggregating treatment liquid has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, derivatives of these compounds, and salts of these.

From the viewpoint of the pH aggregating characteristics with respect to the ink, it is desirable in the present embodiment that the pH of the treatment liquid is adjusted to 1 through 6, more desirably 2 through 5, and further more desirably 3 through 5.

It is desirable in the present embodiment that the added amount in the treatment liquid of the agent for aggregating the pigment and the polymer particles in the ink is not less than 0.01 wt % and not more than 20 wt % with respect to the total weight of the liquid. If the added amount is less than 0.01 wt %, then when the treatment liquid and the ink come into contact, the concentration diffusion may not progress satisfactorily and the aggregating action caused by the pH change may not occur satisfactorily. On the other hand, if the added amount is greater than 20 wt %, then the ejection characteristics from the ejection head may deteriorate.

It is also possible to add a resin component to the treatment liquid in order to improve the fixing characteristics and the wear resistance. The resin component may be any resin that has stable storage characteristics, and that does not impair the ejection characteristics from the ejection head if the treatment liquid is ejected in the form of droplets from the ejection head, and it is possible freely to choose a water-soluble resin, resin emulsion, or the like.

An acrylic resin, a urethane resin, a polyester, a vinyl resin, and a styrene resin can be considered as the resin components. In order to demonstrate a sufficient function of improving the fixing ability, a polymer with a comparatively high molecular weight has to be added at a high concentration of 1 wt % to 20 wt %. However, where such a material is added to and dissolved in a liquid, the viscosity thereof increases and ejection ability is degraded. A latex can be effectively added as an adequate material that can be added to a high concentration, while inhibiting the increase in viscosity. Examples of latex materials include alkyl acrylate copolymers, carboxy-modified SBR (styrene-butadiene latex), SIR (styrene-isoprene) latex, MBR (methyl methacrylate-butadiene latex), and NBR (acrylonitrile-butadiene latex). From the standpoint of the process, in order to improve both the stability during storage at normal temperature and the transferability after heating, while ensuring a strong effect during fixing, it is preferred that the glass transition temperature Tg of the latex be not lower than 50° C. and not higher than 120° C. Moreover, the minimum film forming temperature (MFT) of the latex also has a significant effect on fixing during the process, and it is desirably not higher than 100° C., and more desirably not higher than 50° C., in order to achieve suitable fixing at low temperatures.

The aggregation ability may be further improved by introducing polymer particles of reverse polarity with respect to that of the ink into the treatment liquid and causing the aggregation of the pigment contained in the ink with the polymer particles.

The aggregation ability may be also improved by introducing a curing agent corresponding to the polymer particle component contained in the ink into the treatment liquid, bringing the two liquids into contact, causing aggregation and also crosslinking or polymerization of the resin emulsion in the ink component.

The treatment liquid in the present embodiment can include a surfactant.

Examples of suitable surfactants of a hydrocarbon system include anionic surfactants such as fatty acid salts, alkylsulfuric acid esters and salts, alkylbenzenesulfonic acid salts, alkylnaphthalenesulfonic acid salts, dialkylsulfosuccinic acid salts, alkylphosphoric acid esters and salts, naphthalenesulfonic acid formalin condensate, and polyoxyethylene alkylsulfuric acid esters and salts, and nonionic surfactants such as polyoxyethyelene alkyl ethers, polyoxyethylene alkylallyl ethers, polyoxyethylene fatty acid esters, sorbitan fatty acid esters, polyoxyethylene sorbitan fatty acid esters, polyoxyethylene alkylamines, glycerin fatty acid esters, and oxyethylene oxypropylene block copolymer. It is preferred that SURFYNOLS (manufactured by Air Products & Chemicals), which is an acetylene-type polyoxyethylene oxide surfactant, be used. Amineoxide-type amphoteric surfactants such as N,N-dimethyl-N-alkylamineoxide is also a preferred surfactant.

A surfactant described in Japanese Patent Application Publication No. 59-157636, pages 37 to 38 and Research Disclosure No. 308119 (1989) can be also used. Fluorine-containing (fluorinated alkyl system) and silicone-type surfactants such as described in Japanese Patent Application Publication Nos. 2003-322926, 2004-325707, and 2004-309806 can be also used. These surface tension adjusting agents can be also used as an antifoaming agent. Chelating agents represented by fluorine-containing or silicone-type compounds and EDTA can be also used.

These agents are effective in reducing surface tension and increasing wettability on the recording medium. Further, even when the ink is the first to be deposited, effective aggregation action proceeds because of increased wettability of the ink and enlarged contact surface area of the two liquids.

The viscosity of the treatment liquid in the present embodiment is preferably 1.0 cP to 50.0 cP.

If necessary, a pH buffer agent, an antioxidant, an antimold agent, a viscosity adjusting agent, an electrically conductive agent, an ultraviolet agent, and absorbent, etc. can be also added.

Image Forming Apparatus

FIG. 1 is a general schematic drawing showing an inkjet recording apparatus according to an embodiment of the present invention. The inkjet recording apparatus 100 shown in FIG. 1 is a recoding apparatus that employs a two-liquid aggregation system using ink and treatment liquid (aggregating treatment liquid) to form an image on a recording medium 114.

The inkjet recording apparatus 100 includes: a paper supply unit 102, which supplies the recording medium 114; a treatment liquid deposition unit 106, which deposits the treatment liquid on the recording medium 114; a print unit (image forming unit) 108, which forms an image by depositing droplets of colored ink onto the recording medium 114; a fixing unit 110, which fixes the image formed on the recording medium 114; and a paper output unit 112, which conveys and outputs the recording medium 114 on which the image has been formed.

A paper supply platform 120 on which the recording media 114 are stacked is provided in the paper supply unit 102. A feeder board 122 is connected to the front (the left-hand side in FIG. 1) of the paper supply platform 120, and the recording media 114 stacked on the paper supply platform 120 are supplied one sheet at a time, successively from the uppermost sheet, to the feeder board 122. The recording medium 114 that has been conveyed to the feeder board 122 is transferred through a transfer drum 124*a* to a pressure drum (treatment liquid drum) 126*a* of the treatment liquid deposition unit 106.

Although not shown in the drawings, holding hooks (grippers) and a suction port for holding the leading edge of the recording medium 114 are formed on the surface (circumferential surface) of the pressure drum 126*a*, and the recording medium 114 that has been transferred to the pressure drum 126*a* from the transfer drum 124*a* is conveyed in the direction of rotation (the counter-clockwise direction in FIG. 1) of the pressure drum 126*a* in a state where the leading edge is held by the holding hooks and the medium adheres tightly to the surface of the pressure drum 126*a* (in other words, in a state where the medium is wrapped about the pressure drum 126*a*). A similar composition is also employed for the other pressure drums 126*b* and 126*c*, which are described hereinafter.

The treatment liquid deposition unit 106 is provided with a treatment liquid application unit 136 and a treatment liquid drying unit 138 at positions opposing the surface of the pressure drum 126*a*, in this order from the upstream side in terms of the direction of rotation of the pressure drum 126*a*.

Figure 2:
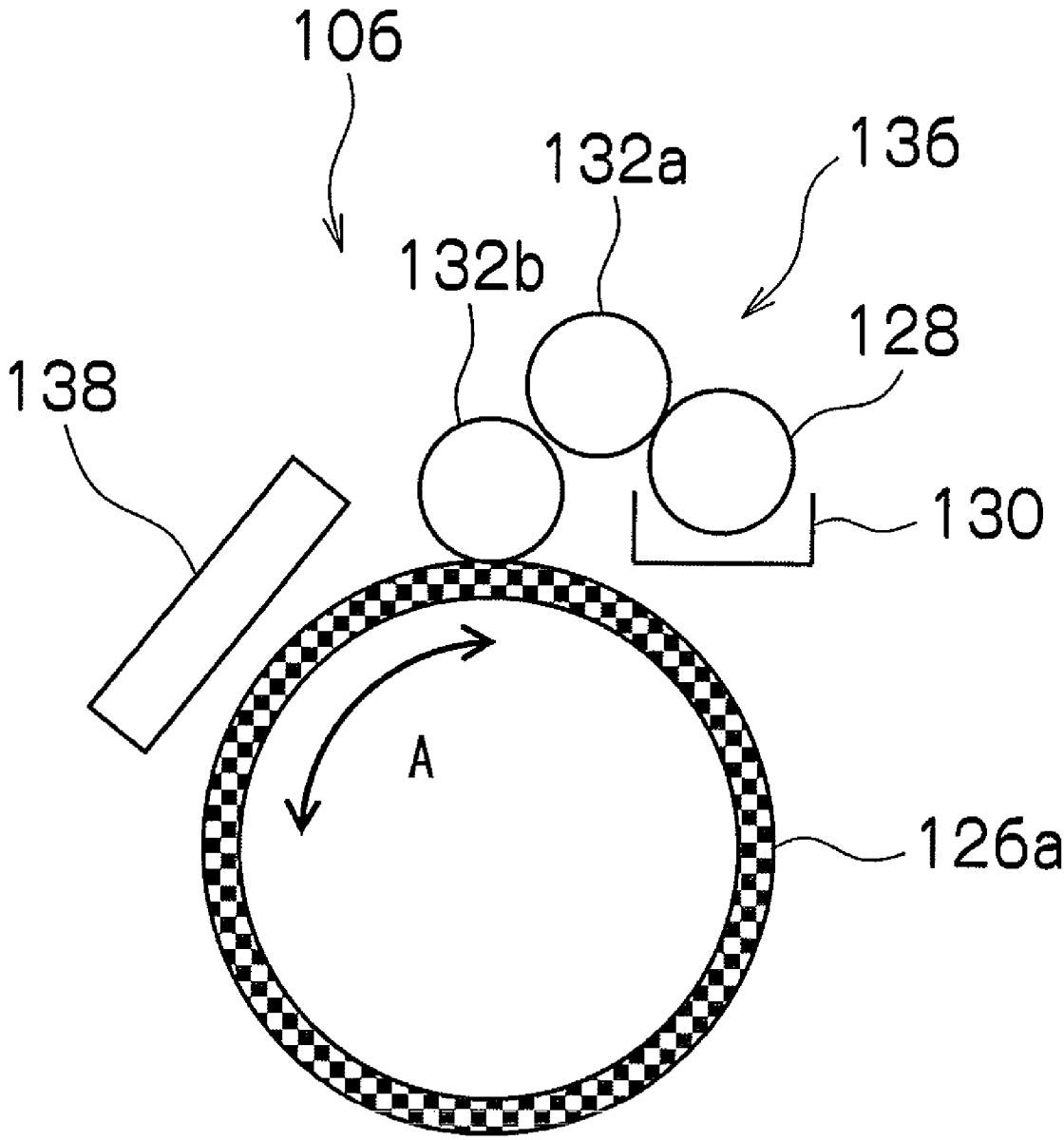
FIG. 2 is an enlarged diagram of a treatment liquid deposition unit.

FIG. 2 is an enlarged diagram of the treatment liquid deposition unit 106. As shown in FIG. 2, the treatment liquid application unit 136 is composed in such a manner that the treatment liquid that has been taken up from a treatment liquid container 130 due to the rotation of a gravure roller 128 is regulated to a prescribed application volume by a blade (not shown), and the treatment liquid is applied to the recording medium 114 that is wrapped about the pressure drum (treatment liquid drum) 126*a* through two-stage rubber rollers 132*a* and 132*b*. In the present embodiment, the diameter of the pressure drum 126*a* is 540 mm and the treatment liquid is deposited on the whole surface of the recording medium 114 to a thickness of 5 μm.

In the present embodiment, an electrorheological fluid, which has electrorheological properties, is used for the above-described treatment liquid (an acidic liquid that has an action of aggregating the coloring material of the ink). Electrorheological fluid is a liquid whose apparent viscosity increases instantaneously when an electric field is applied, and the viscosity of the liquid changes in a reversible fashion with the on and off switching of the electric field.

In general, an electrorheological fluid is principally constituted of a dispersion medium, a dispersion phase, and a surfactant. For the dispersion medium, it is suitable to use a dielectric solvent that is electrically stable, and desirably, a solvent having an intrinsic electrical resistance of 10 kΩcm or greater. Specific examples of same may include: a petroleum-derived fatty hydrocarbon such as kerosene or Isopar, a fatty hydrocarbon such as n-hexane or n-pentane, an aromatic hydrocarbon such as toluene or xylene, or silicone oil, olive oil, liquid paraffin, butyl sebacate, or the like. Furthermore, for the dispersion phase, solid micro-particles having a diameter of 0.01 μm to 10 μm are used. Specific examples are: silica gel, starch, dextrin, carbon black, gypsum, gelatine, alumina, or a polymer such as deionized resin, or the like. Furthermore, the surfactant serves to increase the dispersion stability of the dispersion phase, and an anionic, non-ionic, cationic, or fluorine-based surfactant is used. The combination ratio of the treatment liquid that is made up of the above-described principal constituents is adjusted in such a manner that the viscosity at 25° C. in the absence of an electric field is 1 cP to 50 cP, and desirably, 1 cP to 30 cP.

Furthermore, comb-shaped electrodes are incorporated inside the pressure drum (treatment liquid drum) 126*a* in the present embodiment, thereby adopting a composition whereby an electric field is applied to the treatment liquid on the recording medium 114.

Figure 3:
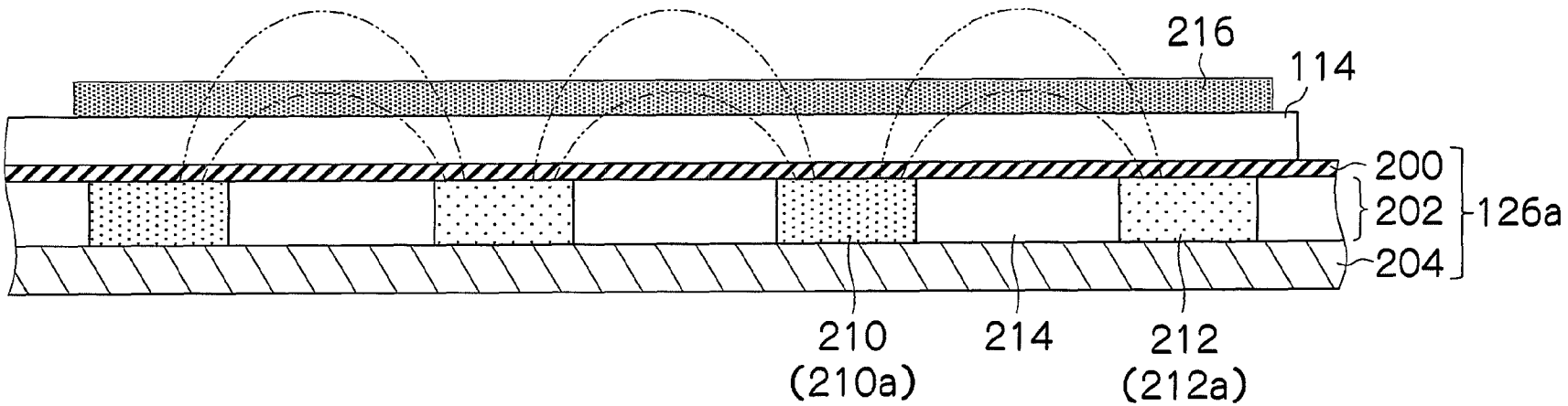
FIG. 3 is a cross-sectional diagram showing the internal structure of the surface side of a treatment liquid drum.
Figure 4:
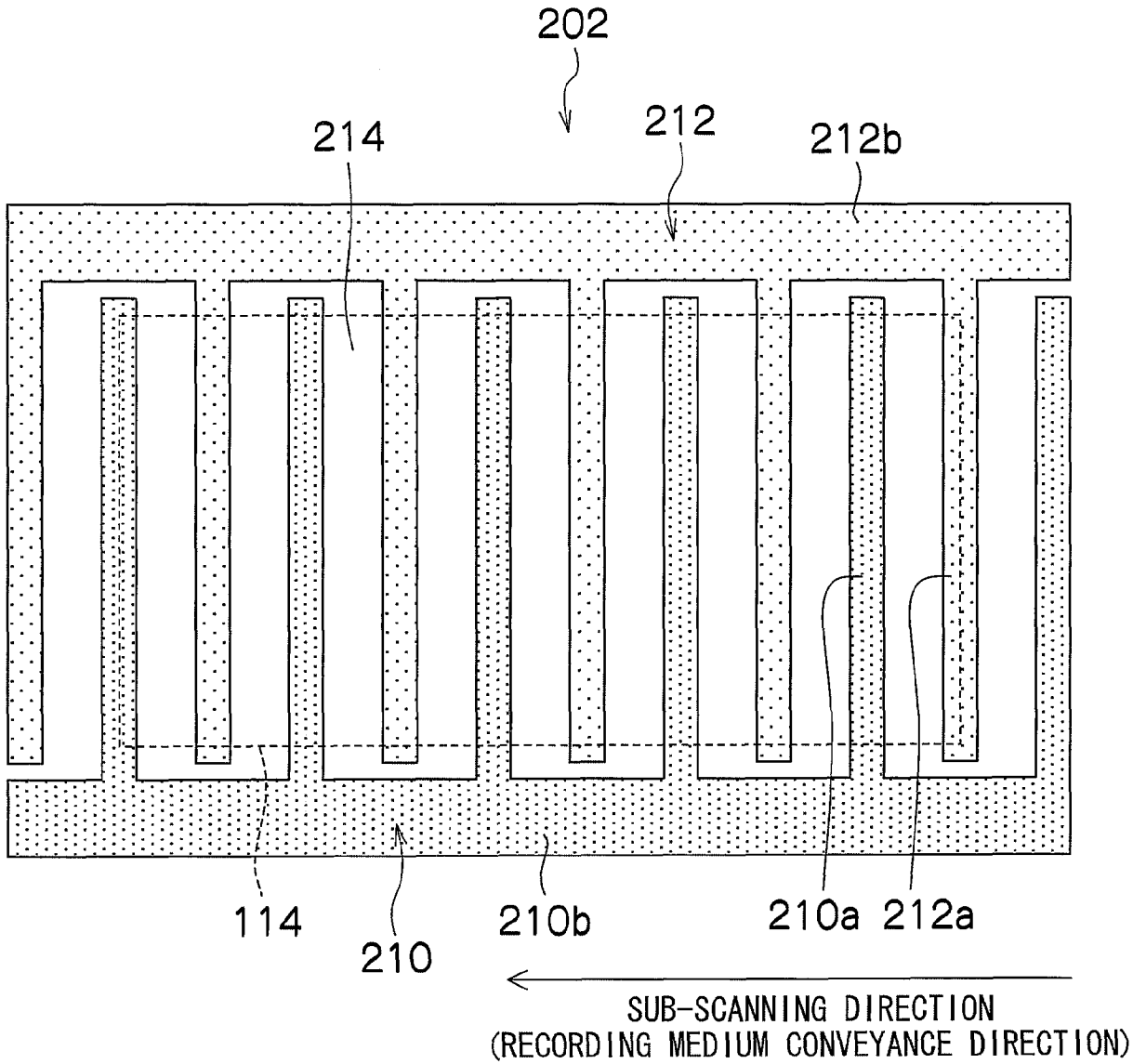
FIG. 4 is an expanded plan diagram of an electrode layer of the treatment liquid drum.

FIG. 3 is a cross-sectional diagram showing the internal structure of the surface side of the treatment liquid drum 126*a* (in practice, this has a circular circumferential shape, but is depicted simply as a straight line structure in the drawing), and FIG. 4 is a plan diagram in which the electrode layer of the treatment liquid drum 126*a* is two-dimensionally developed.

As shown in FIG. 3, the internal structure of the surface side of the treatment liquid drum 126*a* is a three-layer structure including a surface layer 200, which constitutes a supporting surface for the recording medium 114 and an electrode layer 202, a supporting layer 204, and the electrode layer 202 interposed between the layers 200 and 204. A first comb-shaped electrode 210 and a second comb-shaped electrode 212 are provided in the electrode layer 202, and an insulating layer 214 is formed so as to cover the gaps between the comb-shaped electrodes 210 and 212.

As shown in FIG. 4, the first comb-shaped electrode 210 has a plurality of first comb teeth 210*a*, which are connected together through a base 210*b*. The second comb-shaped electrode 212 similarly has a plurality of second comb teeth 212*a*, which are connected together through a base 212*b*. The first comb teeth 210*a* and the second comb teeth 212*a* are formed so as to extend in a direction that is parallel to the breadthways direction of the recording medium 114 and perpendicular to the direction of rotation of the treatment liquid drum 126*a* (the direction of conveyance of the recording medium 114), and they are alternatively disposed in the direction of rotation of the treatment liquid drum 126*a*. The recording medium 114 (indicated by broken lines in FIG. 4) is held in the region where the first and second comb teeth 210*a* and 212*b* are alternatively disposed.

By adopting the electrode structure thus composed of the comb-shaped electrodes 210 and 212, when a prescribed voltage is applied between the first comb-shaped electrode 210 and the second comb-shaped electrode 212 by means of a power supply device (not shown), then an electric field is formed between the teeth 210*a* and 212*a* that are mutually adjacent in the direction of rotation of the treatment liquid drum 126*a*. For example, electric flux lines of the electric field thereby formed are depicted with double-dotted lines in FIG. 3. Thus, an electric field is applied to the treatment liquid 216 on the recording medium 114, and the treatment liquid 216 is increased in viscosity due to the electrorheological effect and therefore permeation of the treatment liquid into the recording medium 114 is suppressed.

In the present embodiment, the composition is adopted in which the electric field is applied to the treatment liquid on the recording medium 114, at least from the position where the treatment liquid is applied onto the recording medium 114 by the treatment liquid application unit 136 (the treatment liquid application position) until the recording medium 114 passes the position corresponding to the treatment liquid drying unit 138 (the treatment liquid drying position) (i.e., in the range indicated by an arrow A in FIG. 2). For example, it is also possible to apply the electric field selectively in accordance with the presence or absence of the recording medium 114 and the position of rotation of the treatment liquid drum 126*a*. Of course, it is also possible to apply the electric field over the whole range (whole circumferential surface) of the treatment liquid drum 126*a*.

The intensity of the electric field applied to the treatment liquid on the recording medium 114 should be set appropriately in accordance with the type of the treatment liquid (i.e., the electrorheological fluid), the internal structure of the pressure drum 126*a* (and especially, the electrode structure), and other factors. In the present embodiment, the electric field intensity is set to 10 kV/cm.

In the present embodiment, the surface layer 200 is desirably a thin film layer having very weak conductive properties (a weak conductive thin film layer). For example, it is possible to use a conductive rubber in which rubber is kneaded together with carbon or metal powder. Desirably, the surface layer 200 has an electrical resistivity of $10^8$ to $10^{12}$ Ωcm and a thickness of approximately 0.01 mm to 1 mm. When a voltage is applied between the first comb-shaped electrode 210 and the second comb-shaped electrode 212, very small electric current flows in the treatment liquid on the recording medium 114 through the surface layer 200, and the increase in the viscosity of the treatment liquid can thereby be promoted.

As the device for applying the treatment liquid to the recording medium 114, it is also possible to use an inkjet type of recording head (inkjet head). By ejecting and depositing droplets of the treatment liquid selectively from the inkjet head in accordance with the image signal, it is possible to shorten the drying time of the treatment liquid and also to save heating energy.

The treatment liquid drying unit 138 is provided with a hot air drying device blowing hot air of which the temperature and flow rate can be controlled within a prescribed range, thereby achieving a composition where the hot air heated by the hot air drying device is blown onto the treatment liquid on the recording medium 114 when the recording medium 114 that is held on the pressure drum 126*a* passes the position corresponding to the heater of the treatment liquid drying unit 138. In the present embodiment, the treatment liquid is dried by means of the hot air of 80° C.

The temperature and flow rate of the hot air drying device are set to values whereby the treatment liquid having been deposited on the recording medium 114 by the treatment liquid head 136 disposed to the upstream side in terms of the direction of rotation of the pressure drum 126*a* is dried so that a solid or semi-solid aggregating treatment agent layer (a thin film layer of dried treatment liquid) is formed on the surface of the recording medium 114.

The "solid or semi-solid aggregating treatment agent layer" includes a layer having a solvent content rate of 0% to 70%, where the solvent content rate is defined as: "Solvent content rate"="Weight of solvent contained in treatment liquid after drying, per unit surface area ($g/m^2$)"/"Weight of treatment liquid after drying, per unit surface area ($g/m^2$)".

A desirable mode is one in which the recording medium 114 is preheated before depositing the treatment liquid on the recording medium 114. More specifically, a paper preheating unit provided with a heater is arranged at the upstream side of the treatment liquid application unit 136 and the downstream side of the transfer drum 124*b* in terms of the direction of rotation of the pressure drum 126*a*, so that the recording medium 114 is preliminarily heated before the application of the treatment liquid performed by the treatment liquid application unit 136. Thus, it is possible to restrict the heating energy required to dry the treatment liquid to a low level, and therefore energy savings can be made.

The print unit 108 is arranged after the treatment liquid deposition unit 106. A transfer drum 124*b* is arranged between the pressure drum (treatment liquid drum) 126*a* of the treatment liquid deposition unit 106 and a pressure drum (print drum) 126*b* of the print unit 108, so as to make contact with same. Hence, after the treatment liquid is deposited and the solid or semi-solid aggregating treatment agent layer is formed on the recording medium 114 that is held on the pressure drum 126*a* of the treatment liquid deposition unit 106, the recording medium 114 is transferred through the transfer drum 124*b* to the pressure drum 126*b* of the print unit 108.

The print unit 108 is provided with inkjet heads 140C, 140M, 140Y, 140K, 140R, 140G and 140B, which correspond respectively to the seven colors of ink, C, M, Y, K, R, G and B, and solvent drying units 142*a* and 142*b* at positions opposing the surface of the pressure drum 126*b*, in this order from the upstream side in terms of the direction of rotation of the pressure drum 126*b* (the counter-clockwise direction in FIG. 1).

An ink storing and loading unit (not shown) is configured by ink tanks that store colored inks supplied to the inkjet heads 140C, 140M, 140Y, 140K, 140R, 140G and 140B. Each ink tank communicates with a corresponding head through a required channel, and supplies the corresponding ink to the head. The ink storing and loading unit also includes a notification device (display device, alarm sound generator) such that when the residual amount of ink is small, the user is notified to this effect. In addition, the ink storing and loading unit includes a mechanism preventing the erroneous loading of colored inks.

The colored inks are supplied to the inkjet heads 140C, 140M, 140Y, 140K, 140R, 140G and 140B from the tanks of the ink storing and loading unit, and droplets of the colored inks are ejected and deposited to the recording medium 114 by the inkjet heads 140C, 140M, 140Y, 140K, 140R, 140G and 140B in accordance with the image signal.

Each of the inkjet heads 140C, 140M, 140Y, 140K, 140R, 140G and 140B is a full-line head having a length corresponding to the maximum width of the image forming region of the recording medium 114 held on the pressure drum 126*b*, and having a plurality of nozzles 161 (not shown in FIG. 1 and shown in FIGS. 5A to 5C) for ejecting the ink, which are arranged on the ink ejection surface of the head through the full width of the image forming region. The inkjet heads 140C, 140M, 140Y, 140K, 140R, 140G and 140B are arranged so as to extend in a direction that is perpendicular to the direction of rotation of the pressure drum 126*c* (the conveyance direction of the recording medium 114).

According to the composition in which the full line heads having the nozzle rows covering the full width of the image forming region of the recording medium 114 are provided respectively for the colors of ink, it is possible to record a primary image on the image forming region of the recording medium 114 by performing just one operation of moving the recording medium 114 and the inkjet heads 140C, 140M, 140Y, 140K, 140R, 140G and 140B relatively with respect to each other (in other words, by one sub-scanning action). Therefore, it is possible to achieve a higher printing speed compared to a case that uses a serial (shuttle) type of head moving back and forth reciprocally in the main scanning direction, which is the direction perpendicular to the sub-scanning direction or the conveyance direction of the recording medium 114, and hence it is possible to improve the print productivity.

The inkjet recording apparatus 100 according to the present embodiment is able to record on recording media (recording paper) up to a maximum size of 720 mm×520 mm and hence a drum having a diameter of 810 mm corresponding to the recording medium width of 720 mm is used for the pressure drum (print drum) 126*b*. The drum rotation peripheral speed when depositing the ink droplets is 530 mm/sec. The ink ejection volume of the heads 140C, 140M, 140Y, 140K, 140R, 140G and 140B is 2 pl, and the recording density is 1200 dpi in both the main scanning direction (the breadthways direction of the recording medium 114) and the sub-scanning direction (the conveyance direction of the recording medium 114). The ejection frequency is 25 kHz.

Although the configuration with the seven colors of C, M, Y, K, R, G and B is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added. Furthermore, there is no particular restriction on the arrangement sequence of the heads of the respective colors.

Each of the solvent drying units 142*a* and 142*b* has a composition provided with a hot air drying device blowing hot air of which the temperature and flow rate can be controlled within a prescribed range, similarly to the treatment liquid drying unit 138, which have been described above. As described hereinafter, when ink droplets are deposited onto the solid or semi-solid aggregating treatment agent layer, which has been formed on the recording medium 114, an ink aggregate (coloring material aggregate) is formed on the recording medium 114, and furthermore, the ink solvent that has separated from the coloring material spreads, so that a liquid layer containing dissolved aggregating treatment agent is formed. The solvent component (liquid component) left on the recording medium 114 in this way is a cause of curling of the recording medium 114 and also leads to deterioration of the image. Therefore, in the present embodiment, after depositing the droplets of the colored inks from the heads 140C, 140M, 140Y, 140K, 140R, 140G and 140B onto the recording medium 114, the hot air drying devices of the solvent drying units 142*a* and 142*b* blow the hot air of 70° C. onto the recording medium 114 so that the solvent component is evaporated off and the recording medium 114 is dried.

The fixing unit 110 is arranged after the print unit 108. A transfer drum 124*c* is arranged between the pressure drum (print drum) 126*b* of the print unit 108 and a pressure drum (fixing drum) 126*c* of the fixing unit 110, so as to make contact with same. Hence, after the colored inks are deposited on the recording medium 114 that is held on the pressure drum 126*b* of the print unit 108, the recording medium 114 is transferred through the transfer drum 124*c* to the pressure drum 126*c* of the fixing unit 110.

The fixing unit 110 is provided with a print determination unit 144, which reads in the print results of the print unit 108, and a heating roller 148 at positions opposing the surface of the pressure drum 126*c*, in this order from the upstream side in terms of the direction of rotation of the pressure drum 126*c* (the counter-clockwise direction in FIG. 1).

The print determination unit 144 includes an image sensor (a line sensor, or the like), which captures an image of the print result of the print unit 108 (the droplet ejection results of the heads 140C, 140M, 140Y, 140K, 140R, 140G and 140B), and functions as a device for checking for nozzle blockages and other ejection defects, on the basis of the droplet ejection image captured through the image sensor.

The heating roller 148 is a roller of which temperature can be controlled in a prescribed range (e.g., 100° C. to 180° C.), and the image formed on the recording medium 114 is fixed while nipping the recording medium 114 between the heating roller 148 and the pressure drum 126*c* to heat and pressurize the recording medium 114. In the present embodiment, the heating temperature of the heating roller 148 is 110° C. and the surface temperature of the pressure drum 126*a* is set to 60° C. Furthermore, the nip pressure of the heating roller 148 is 1 MPa. Desirably, the heating temperature of the heating roller 148 is set in accordance with the glass transition temperature of the polymer particles contained in the treatment liquid or the ink. It is also possible to provide a plurality of heating rollers in such a manner that the image formed on the recording medium 114 can be fixed in a stepwise fashion.

The paper output unit 112 is arranged after the fixing unit 110. The paper output unit 112 is provided with a paper output drum 150, which receives the recording medium 114 on which the image has been deposited, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

Next, the structure of the inkjet heads is described in detail. The inkjet heads 140C, 140M, 140Y, 140K, 140R, 140G and 140B have a common structure, and in the following description, these heads are represented by an ink head (hereinafter, simply called a "head") denoted with reference numeral 160.

Figure 5A:
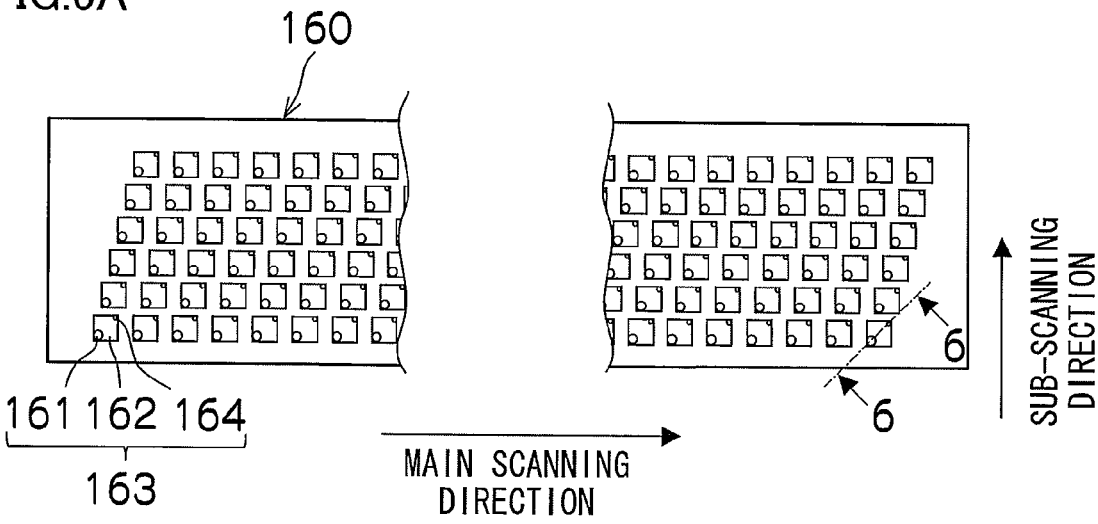
FIGS. 5A to 5C are plan view perspective diagrams showing compositions of inkjet heads.
Figure 5B:
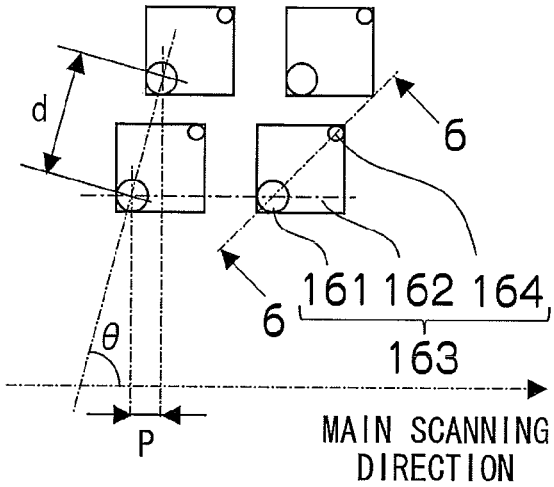
Figure 5C:
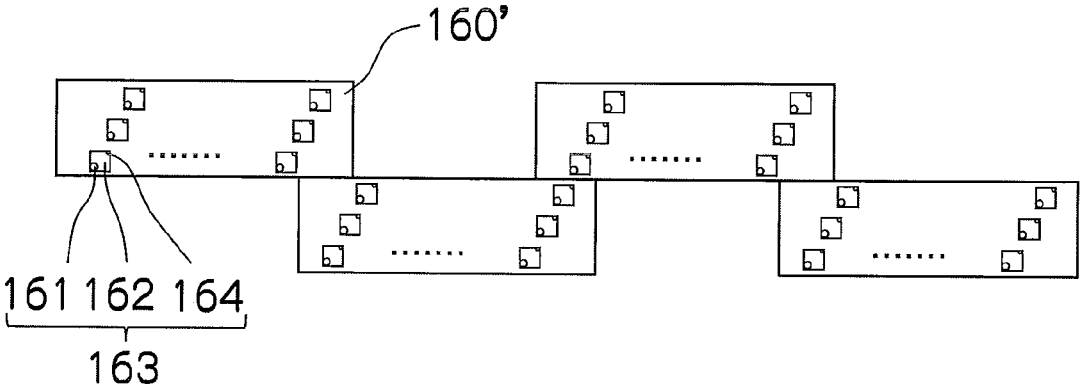
Figure 6:
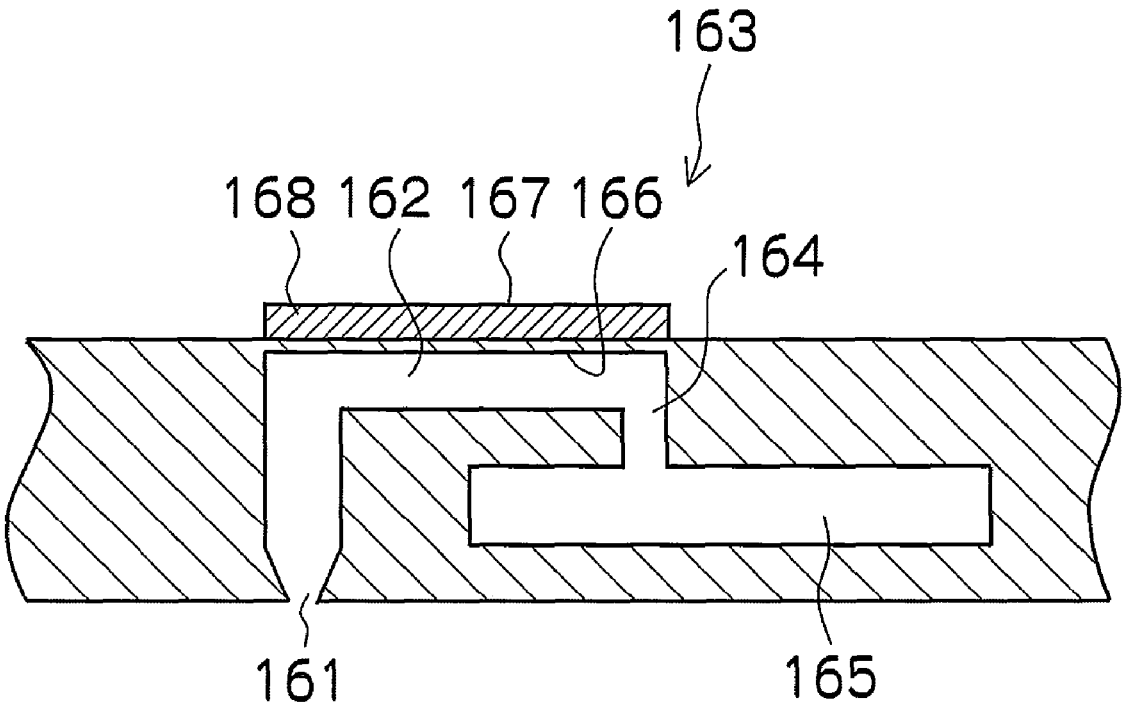
FIG. 6 is a cross-sectional diagram along line 6-6 in FIGS. 5A and 5B.

FIG. 5A is a plan view perspective diagram showing an embodiment of the structure of the head 160; FIG. 5B is an enlarged diagram showing a portion of the head; and FIG. 5C is a plan view perspective diagram showing a further embodiment of the structure of the head 160. FIG. 6 is a cross-sectional diagram along line 6-6 in FIGS. 5A and 5B, and shows the three-dimensional composition of an ink chamber unit.

The nozzle pitch in the head 160 should be minimized in order to maximize the density of the dots formed on the surface of the recording medium 114. As shown in FIGS. 5A and 5B, the head 160 according to the present embodiment has a structure in which a plurality of ink chamber units 163, each having a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

The mode of forming one or more nozzle rows through a length corresponding to the entire width of the recording area of the recording medium 114 in a direction substantially perpendicular to the conveyance direction of the recording medium 114 is not limited to the embodiment described above. For example, instead of the configuration in FIG. 5A, as shown in FIG. 5C, a line head having the nozzle rows of the length corresponding to the entire width of the recording area of the recording medium 114 can be formed by arranging and combining, in a staggered matrix, short head blocks 160' each having a plurality of nozzles 161 arrayed two-dimensionally. Furthermore, although not shown in the drawings, it is also possible to compose a line head by arranging short heads in one row.

The pressure chamber 162 provided corresponding to each of the nozzles 161 is approximately square-shaped in plan view, and the nozzle 161 and a supply port 164 are arranged respectively at corners on a diagonal of the pressure chamber 162. Each pressure chamber 162 is connected through the supply port 164 to a common flow channel 165. The common flow channel 165 is connected to an ink supply tank (not shown), which is a base tank that supplies ink, and the ink supplied from the ink supply tank is delivered through the common flow channel 165 to the pressure chambers 162.

A piezoelectric element 168 provided with an individual electrode 167 is bonded to a diaphragm 166, which forms the upper face of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As shown in FIG. 5B, the high-density nozzle head according to the present embodiment is achieved by arranging the plurality of ink chamber units 163 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting the structure in which the plurality of ink chamber units 163 are arranged at the uniform pitch d in line with the direction forming the angle of θ with respect to the main scanning direction, the pitch P of the nozzles projected so as to align in the main scanning direction is d×cos θ, and hence the nozzles 161 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 114 is moved in the breadthways direction (main scanning direction) of the recording medium 114, thereby performing printing in the breadthways direction, and when one printing action in the breadthways direction has been completed, the recording medium 114 is moved through a prescribed amount in the sub-scanning direction perpendicular to the breadthways direction, printing in the breadthways direction of the recording medium 114 is carried out in the next printing region, and by repeating this sequence, printing is performed over the whole surface of the printing region of the recording medium 114.

Figure 7:
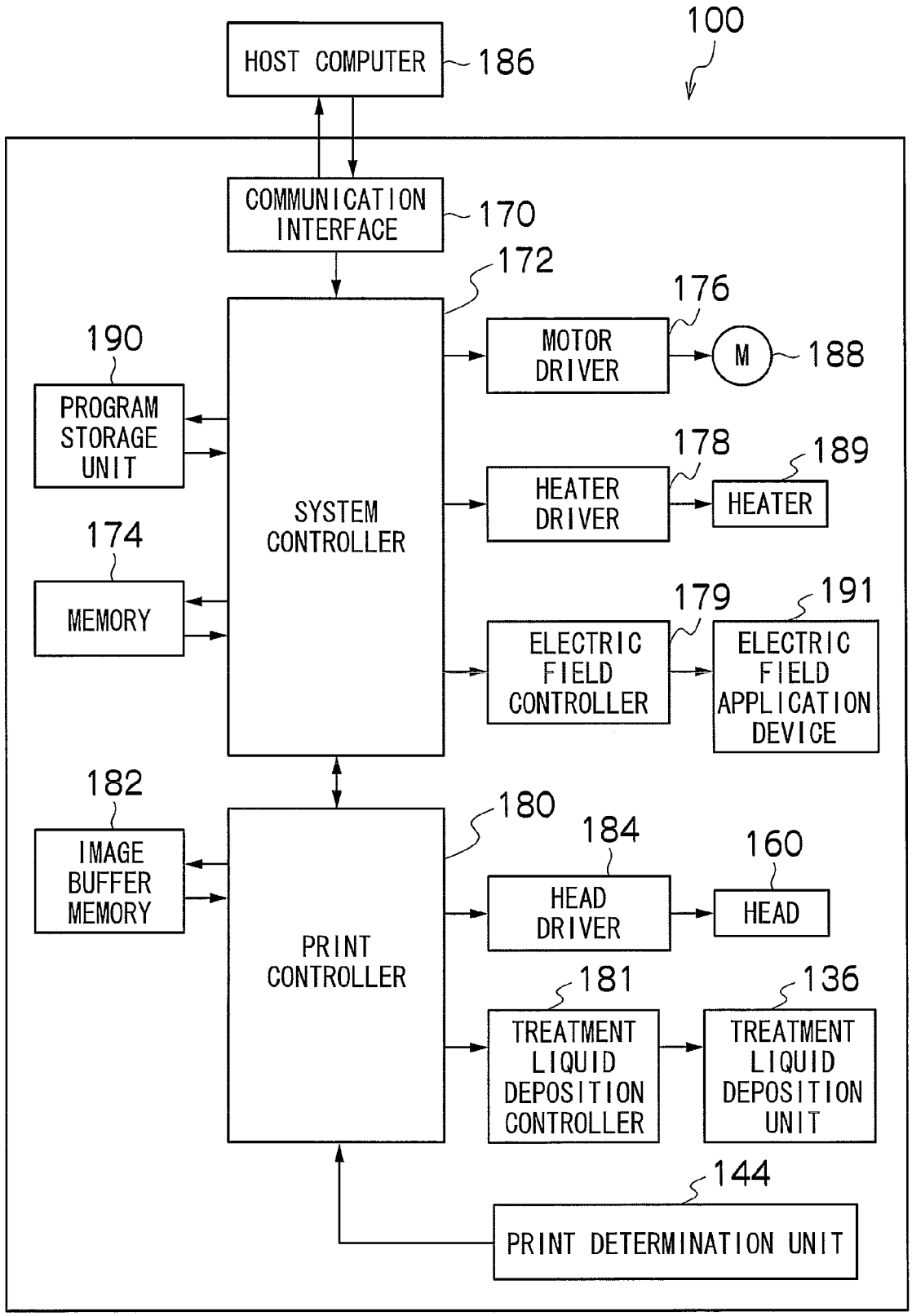
FIG. 7 is a principal block diagram showing a system configuration of the inkjet recording apparatus shown in FIG. 1.

FIG. 7 is a principal block diagram showing the system configuration of the image forming apparatus 100. The image forming apparatus 100 includes a communication interface 170, a system controller 172, a memory 174, a motor driver 176, a heater driver 178, an electric field controller 179, a print controller 180, a treatment liquid deposition controller 181, an image buffer memory 182, a head driver 184, and the like.

The communication interface 170 is an interface unit for receiving image data sent from a host computer 186. A serial interface such as USB (Universal Serial Bus), IEEE1394, Ethernet, wireless network, or a parallel interface such as a Centronics interface may be used as the communication interface 170. A buffer memory (not shown) may be mounted in this portion in order to increase the communication speed. The image data sent from the host computer 186 is received by the image forming apparatus 100 through the communication interface 170, and is temporarily stored in the memory 174.

The memory 174 is a storage device for temporarily storing image data inputted through the communication interface 170, and data is written and read to and from the memory 174 through the system controller 172. The memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the image forming apparatus 100 in accordance with a prescribed program, as well as a calculation device for performing various calculations. More specifically, the system controller 172 controls the various sections, such as the communication interface 170, memory 174, motor driver 176, heater driver 178, and the like, as well as controlling communications with the host computer 186 and writing and reading to and from the memory 174, and it also generates control signals for controlling the motor 188 and heater 189 of the conveyance system.

The program executed by the CPU of the system controller 172 and the various types of data which are required for control procedures are stored in the memory 174. The memory 174 may be a non-rewriteable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 176 is a driver that drives the motor 188 in accordance with instructions from the system controller 172. In FIG. 7, the plurality of motors (actuators) disposed in the respective sections of the image forming apparatus 100 are represented by the reference numeral 188. For example, the motor 188 shown in FIG. 7 includes the motors that drive the pressure drums 126*a* to 126*c*, the transfer drums 124*a* to 124*c* and the paper output drum 150, shown in FIG. 1.

The heater driver 178 is a driver that drives the heater 189 in accordance with instructions from the system controller 172. In FIG. 7, the plurality of heaters disposed in the image forming apparatus 100 are represented by the reference numeral 189. For example, the heater 189 shown in FIG. 7 includes the heaters of the treatment liquid drying unit 138, the hot air drying devices of the solvent drying units 142*a* and 142*b*, and the like, shown in FIG. 1.

The electric field controller 179 controls an electric field application device 191 that applies the electric field to the treatment liquid on the recording medium 114. More specifically, the electric field application timing, the electric field application duration and the electric field intensity, and other characteristics, of the electric field application device 191 are controlled in such a manner that the electric field is applied to the treatment liquid on the recording medium 114, during the time that the recording medium 114 passes from the position at which the treatment liquid is deposited onto the recording medium 114 by the treatment liquid application unit 136 (the treatment liquid application position) until the position opposing the treatment liquid drying unit 138 (the treatment liquid drying position) (i.e., in the range indicated by the arrow A in FIG. 2) as shown in FIG. 2, in other words, from the deposition of the treatment liquid onto the recording medium 114 until the formation of the solid or semi-solid aggregating treatment agent layer. It is possible to determine the electric field application conditions (the electric field application timing, electric field intensity, electric field application duration, and the like) for each of the types of the treatment liquid and to store this information in a prescribed memory (for example, the memory 174) in the form of a data table in advance, in such a manner that the memory is read and the electric field application device 191 is controlled accordingly whenever information relating to the treatment liquid is acquired.

The print controller 180 is a control unit that has signal processing functions for carrying out processing, correction, and other treatments in order to generate a print control signal on the basis of the image data in the memory 174 in accordance with the control of the system controller 172. The print controller 180 supplies the print data (dot data) thus generated to the head driver 184. Prescribed signal processing is carried out in the print controller 180, and the ejection volume and the ejection timing of the ink droplets in the head 160 are controlled through the head driver 184 on the basis of the image data. By this means, prescribed dot size and dot positions can be achieved. In FIG. 7, the plurality of heads (inkjet heads) disposed in the inkjet recording apparatus 100 are represented by the reference numeral 160. For example, the head 160 shown in FIG. 7 includes the heads 140C, 140M, 140Y, 140K, 140R, 140G and 140B shown in FIG. 1.

The treatment liquid deposition controller 181 controls the amount of the treatment liquid applied by the treatment liquid application unit 136. In the present embodiment, it is possible to move the treatment liquid application unit 136 to be in contact with and separated from the recording medium 114 held on the pressure drum 126*a*, so that the application amount of the treatment liquid is controlled by adjusting the time period in which the treatment liquid application unit 136 is in contact with the recording medium 114. A sensor is provided to detect the amount of the treatment liquid stored in the treatment liquid container 130, and the treatment liquid deposition controller 181 determines the residual amount of the treatment liquid stored in the treatment liquid container 130 according to the information obtained through the sensor, and gives an alarm when the residual amount becomes smaller than the predetermined value.

The print controller 180 is provided with the image buffer memory 182, and image data, parameters, and other data are temporarily stored in the image buffer memory 182 when image data is processed in the print controller 180. Also possible is an aspect in which the print controller 180 and the system controller 172 are integrated to form a single processor.

The head driver 184 generates drive signals to be applied to the piezoelectric elements 168 of the head 160, on the basis of image data supplied from the print controller 180, and also has drive circuits which drive the piezoelectric elements 168 by applying the drive signals to the piezoelectric elements 168. A feedback control system for maintaining constant drive conditions in the head 160 may be included in the head driver 184 shown in FIG. 7.

The print determination unit 144 is a block that includes the line sensor as described above with reference to FIG. 1, reads the image printed on the recording medium 114, determines the print conditions (presence of the ejection, variation in the dot formation, and the like) by performing desired signal processing, or the like, and provides the determination results of the print conditions to the print controller 180. According to requirements, the print controller 180 makes various corrections with respect to the head 160 on the basis of information obtained from the print determination unit 144.

The operation of the image forming apparatus 100 which has this composition is described below.

The recording medium 114 is conveyed to the feeder board 122 from the paper supply platform 120 of the paper supply unit 102, and is transferred through the transfer drum 124*a* onto the pressure drum 126*a* of the treatment liquid deposition unit 106. The treatment liquid is applied to the surface of the recording medium 114 held on the pressure drum 126*a* by the treatment liquid application unit 136. Thereupon, the recording medium 114 held on the pressure drum 126*a* is heated by the treatment liquid drying unit 138, and the solvent component (liquid component) of the treatment liquid is evaporated and the recording medium 114 is thereby dried. Thus, a solid or semi-solid aggregating treatment agent layer is formed on the surface of the recording medium 114.

In the present embodiment, the treatment liquid having electrorheological properties is used as described above, and an electric field is applied to the treatment liquid on the recording medium 114 at least during the time that the recording medium 114 travels from the position where the treatment liquid is applied (the treatment liquid applying position) to the recording medium 114 by the treatment liquid application unit 136 until the position opposing the treatment liquid drying unit 138 (the treatment liquid drying position) (i.e., the range indicated by the arrow A in FIG. 2), in other words, from the application of the treatment liquid onto the recording medium 114 until the formation of the solid or semi-solid aggregating treatment agent layer. Therefore, the viscosity of the treatment liquid that has been applied to the recording medium 114 is raised instantaneously and the treatment liquid dries in a state where it is restricted from permeating into the recording medium 114. Consequently, it is possible reliably to form the solid or semi-solid aggregating treatment agent layer of sufficient volume on the surface of the recording medium 114.

The recording medium 114 on which the solid or semi-solid aggregating treatment agent layer has been formed is transferred from the pressure drum 126*a* of the treatment liquid deposition unit 106 though the transfer drum 124*b* to the pressure drum 126*b* of the print unit 108. Droplets of corresponding colored inks are ejected respectively from the heads 140C, 140M, 140Y, 140K, 140R, 140G and 140B, toward the recording medium 114 held on the pressure drum 126*b*, in accordance with the input image data.

The ink droplets ejected from the heads 140C, 140M, 140Y, 140K, 140R, 140G and 140B are deposited onto the solid or semi-solid aggregating treatment agent layer formed on the recording medium 114. At this time, the contact interface between each ink droplet and the aggregating treatment agent layer has a prescribed area when the ink droplet lands, due to a balance between the kinetic energy and the surface energy. The aggregating reaction starts immediately after the ink droplets have landed on the aggregating treatment agent, and the aggregating reaction starts from the surface of each ink droplet in contact with the aggregating treatment agent layer. Since the aggregating reaction occurs only in the vicinity of the contact surface, and the coloring material in the ink aggregates while the ink droplet obtains an adhesive force in the prescribed contact interface area upon landing of the ink droplet, then movement of the coloring material is suppressed.

Even if another ink droplet is subsequently deposited adjacently to the ink droplet deposited previously, since the coloring material of the previously deposited ink has already aggregated, then the coloring material does not mix with the subsequently deposited ink, and therefore bleeding is suppressed. After the aggregation of the coloring material, the separated ink solvent spreads, and a liquid layer containing dissolved aggregating treatment agent is formed on the recording medium 114.

Thereupon, the recording medium 114 held on the pressure drum 126*b* is heated by the solvent drying units 142*a* and 142*b*, and the solvent component (liquid component) that has been separated from the ink aggregate on the recording medium 114 is evaporated off and the recording medium 114 is thereby dried. Thus, curling of the recording medium 114 is prevented, and furthermore deterioration of the image quality as a result of the presence of the solvent component can be restricted.

The recording medium 114 onto which the colored inks have been deposited by the print unit 108 is transferred from the pressure drum 126*b* of the print unit 108 through the transfer drum 124*c* to the pressure drum 126*c* of the fixing unit 110. The print results produced by the print unit 108 on the recording medium 114 held on the pressure drum 126*c* are read in by the print determination unit 144, whereupon the recording medium 114 is heated and pressured by the heating roller 148 to fix the image formed on the recording medium 114.

Then, the recording medium 114 on which the image has been fixed is transferred from the pressure drum 126*c* to the paper output drum 150. The recording medium 114 is then conveyed onto the paper output platform 152 by the paper output chain 154, and is stacked on the paper output platform 152.

Evaluation Experiments

Next, evaluation experiments that were carried out by the inventor in order to confirm the beneficial effects of the present invention will be described.

Firstly, the treatment liquid and the ink used in the evaluation experiments were as described below.

Preparation of the Treatment Liquid

A treatment liquid was prepared by mixing together the following materials:

| | |
|---|---|
| Glycerin | 15 g; |
| Malonic acid | 10 g; |
| Surfactant 1 | 1 g; |
| Silica gel (particle size 0.2 μm) | 5 g; and |
| Isopar E (made by Exxon Inc.) | 69 g. |

The surfactant 1 described above is represented as:

$$CF_3CF_2—(CF_2CF_2)_m—CH_2CH_2—(OCH_2CH_2)_n—OH.$$

The pH of the treatment liquid thus prepared was measured with a Toa DKK pH meter, WM-50EG, and the pH was found to be 3.5.

Preparation of the Ink

A dispersion liquid was prepared by combining and agitating 10 g of Cromophtal Jet Magenta DMQ (PR-122) made by Chiba Specialty Chemicals, 10.0 g of polymer for dispersion, 4.0 g of glycerin, and 26 g of deionized water. Thereupon, ultrasonic waves were irradiated for two hours in an intermittent fashion (irradiation 0.5 seconds/halt 1.0 second) in order to further disperse the pigment, using an ultrasound inadiation apparatus (SONICS Vibra-cell VC-750, tapered micro chip: diameter of 5 mm, amplitude: 30%), and a 20 wt % pigment dispersion liquid was obtained.

Separately from this, the following compounds were measured and mixed together to prepare a mixed liquid I:

| | |
|---|---|
| Glycerin | 5.0 g; |
| Olefin E1010 (made by Nisshin Kagaku Kogyo) | 1.0 g; and |
| Deionized water | 11.0 g. |

This mixed liquid I was titrated slowly into 23.0 g of an agitated 44% SBR dispersion liquid (polymer particles: acrylic acid 3 wt %, Tg 30° C.) and agitated to prepare a mixed liquid II. Furthermore, this mixed liquid II was titrated slowly into the aforementioned 20% pigment dispersion liquid and agitated and mixed, to prepare 100 g of magenta ink.

Experimental Method

In the present evaluation experiments, the solvent content rate of the aggregating treatment agent layer on which the droplets of ink are deposited was varied in the range of 30% to 100% when forming an image onto a recording medium using a system equivalent to the inkjet recording apparatus 100 shown in FIG. 1. More specifically, an aggregating treatment agent layer of a desired solvent content rate was formed on the recording medium by suitably changing the heating temperature and flow rate of the hot air drying machine of the treatment liquid drying unit (denoted with the reference numeral 138 in FIG. 1) when drying the treatment liquid that had been applied to the recording medium.

Furthermore, the intensity of the electric field applied to the treatment liquid on the recording medium between the treatment liquid application position and the treatment liquid drying position was varied in the range of 0 to 10 kV/cm.

In the present evaluation experiments, Urite (matt coated paper) was used as the recording medium.

Images composed of a plurality of lines were formed on the recording medium while varying the solvent content rate of the aggregating treatment agent layer and the intensity of the electric field applied to the treatment liquid on the recording medium in this way, and the images were assessed visually from the viewpoint of "bleeding" and "movement of the coloring material". The assessment criteria of the respective assessment items were as stated below.

Bleeding:

Excellent: when lines were drawn, variation in line thickness was less than 5 μm;

Good: when lines were drawn, variation in line thickness was not less than 5 μm and less than 7 μm;

Fair: when lines were drawn, variation in line thickness was not less than 7 μm and less than 10 μm; and Poor: when lines were drawn, variation in line thickness was not less than 10 μm.

Movement of Coloring Material:

Excellent: no movement of coloring material

Good: movement of coloring material within range of one dot pitch

Poor: movement of coloring material by more than one dot pitch

Experimental Results

Table 1 shows the results of the evaluation experiments.

TABLE 1

| | Solvent content rate of aggregating treatment agent layer (%) | Electric field intensity (kV/cm) | Bleeding | Movement of coloring material |
|---|---|---|---|---|
| Comparative Example 1 | 100 | 0 | Fair | Poor |
| Comparative Example 2 | 70 | 0 | Fair | Good |
| Comparative Example 3 | 50 | 0 | Fair | Excellent |
| Comparative Example 4 | 50 | 6 | Fair | Excellent |
| Practical Example 1 | 50 | 8 | Good | Excellent |
| Practical Example 2 | 50 | 10 | Excellent | Excellent |
| Practical Example 3 | 30 | 10 | Excellent | Excellent |

As Table 1 reveals, when ink droplets are deposited after forming a solid or semi-solid aggregating treatment agent layer (solvent content rate 0% to 70%) on the surface of a recording medium, it is possible to prevent image deterioration due to movement of the coloring material. However, in cases where no electric field is applied to the treatment liquid on the recording medium, during the time from the application of the treatment liquid until the drying of the treatment liquid on the recording medium (Comparative Examples 1 to 3), or in a case where the intensity of the electric field applied to the treatment liquid on the recording medium is 6 kV/cm (Comparative Example 4), then the treatment liquid permeates into the recording medium and it is not possible to prevent bleeding.

On the other hand, in cases where ink droplets are deposited after forming a solid or semi-solid aggregating treatment agent layer (solvent content rate 0 to 70%) on the surface of the recording medium, if the intensity of the electric field applied to the treatment liquid on the recording medium during the time from the application of treatment liquid onto the recording medium until the drying of the treatment liquid is 8 kV/cm (Practical Example 1) or 10 kV/cm (Practical Examples 2 and 3), then it is possible to suppress the permeation of the treatment liquid into the recording medium, and it is possible reliably to form the solid or semi-solid aggregating treatment agent layer on the surface of the recording medium. Hence, it is possible to achieve an efficient aggregating reaction of the ink, and it is possible to prevent image deterioration caused by movement of the coloring material or bleeding.

As described above, according to the present embodiment, by applying an electric field to the treatment liquid (electrorheological fluid) on the recording medium, it is possible to suppress permeation of the treatment liquid that has been deposited on the recording medium, while also reliably forming the solid or semi-solid aggregating treatment agent layer. By depositing ink droplets onto the recording medium on which the solid or semi-solid aggregating treatment agent layer has been formed, it is possible to achieve an efficient ink aggregating reaction on the surface of the recording medium, even in the case of high-speed droplet ejection with a droplet ejection interval of 10 to 50 microseconds, and hence it is possible to prevent image deterioration caused by movement of the coloring material or bleeding, and therefore an image of high quality can be formed.

In the present embodiment, in order to suppress the permeation of the treatment liquid into the recording medium, the electrorheological fluid is used as the treatment liquid; however, the present invention is not limited to this. It is also possible to adopt a mode which uses a magnetic fluid, for example. For the magnetic fluid, it is possible to use a fluid containing ferromagnetic powder having a particle size of approximately 5 nm to 50 nm suspended at a prescribed ratio in water or an organic solvent. For the ferromagnetic powder, it is possible to use magnetite, cobalt-ferrite, nickel-ferrite, manganese-ferrite, or the like. When the magnetic fluid is used as the treatment liquid, then a magnetic field should be created by means of a magnetic field generating device, in such a manner that a magnetic force is applied in the direction in which permeation of the treatment liquid into the recording medium is to be impeded.

Furthermore, as a further method of suppressing the permeation of the treatment liquid into the recording medium, it is also possible to previously deposit an undercoating agent that has a repelling property with respect to the treatment liquid, before depositing the treatment liquid on the recording medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus which forms an image on a recording medium by using an ink and an aggregating treatment agent, the ink containing coloring material, the aggregating treatment agent containing a component which causes the coloring material to aggregate, the apparatus comprising:

a treatment liquid deposition device which deposits a treatment liquid onto the recording medium, the treatment liquid containing the aggregating treatment agent;

a treatment liquid heating device which heats the treatment liquid having been deposited on the recording medium to form a solid or semi-solid layer of the aggregating treatment agent on the recording medium;

a treatment liquid permeation suppression device which suppresses permeation of the treatment liquid into the recording medium at least from a time of deposition of the treatment liquid onto the recording medium until formation of the solid or semi-solid layer of the aggregating treatment agent; and an ink droplet ejection device which ejects and deposits droplets of the ink onto the recording medium on which the solid or semi-solid layer of the aggregating treatment agent has been formed, wherein the treatment liquid permeation suppression device includes a permeation suppression agent deposition device which deposits a permeation suppression agent onto the recording medium before the treatment liquid is deposited onto the recording medium, the permeation suppresion agent having a repelling property with respect to the treatment liquid.

2. The image forming apparatus as defined in claim 1, wherein:

the treatment liquid includes an electrorheological fluid; and the treatment liquid permeation suppression device includes an electric field application device which applies an electric field to the treatment liquid.

3. The image forming apparatus as defined in claim 1, wherein:

the treatment liquid includes a magnetic fluid; and the treatment liquid permeation suppression device includes a magnetic field application device which applies a magnetic field to the treatment liquid.

4. An image forming method of forming an image on a recording medium by using an ink and an aggregating treatment agent, the ink containing coloring material, the aggregating treatment agent containing a component which causes the coloring material to aggregate, the method comprising the steps of:

depositing a treatment liquid onto the recording medium, the treatment liquid containing the aggregating treatment agent;

heating the treatment liquid having been deposited on the recording medium in the depositing step to form a solid or semi-solid layer of the aggregating treatment agent on the recording medium;

suppressing permeation of the treatment liquid into the recording medium at least from a time of deposition of the treatment liquid onto the recording medium in the depositing step until formation of the solid or semi-solid layer of the aggregating treatment agent in the heating step; and ejecting and depositing droplets of the ink onto the recording medium on which the solid or semi-solid layer of the aggregating treatment agent has been formed, wherein in the suppressing step a permeation suppression agent is deposited onto the recording medium before the treatment liquid is deposited onto the recording medium, the permeation suppression agent having a repelling property with respect to the treatment liquid.

* * * * *